US009771230B2

(12) United States Patent
Uehara

(10) Patent No.: US 9,771,230 B2
(45) Date of Patent: Sep. 26, 2017

(54) SHEET CONVEYANCE DEVICE AND IMAGE FORMING APPARATUS

(71) Applicant: KYOCERA Document Solutions Inc., Osaka (JP)

(72) Inventor: Masakazu Uehara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/109,051

(22) PCT Filed: Jan. 22, 2015

(86) PCT No.: PCT/JP2015/051664

§ 371 (c)(1),
(2) Date: Jun. 29, 2016

(87) PCT Pub. No.: WO2015/146255

PCT Pub. Date: Oct. 1, 2015

(65) Prior Publication Data

US 2016/0325954 A1 Nov. 10, 2016

(30) Foreign Application Priority Data

Mar. 27, 2014 (JP) ..... 2014-066310

(51) Int. Cl.
*B65H 3/34* (2006.01)
*B65H 9/00* (2006.01)
(Continued)

(52) U.S. Cl.
CPC ..... *B65H 9/004* (2013.01); *B65H 3/0669* (2013.01); *B65H 3/0684* (2013.01); *B65H 3/34* (2013.01);
(Continued)

(58) Field of Classification Search
CPC ..... B65H 9/004; B65H 3/34; B65H 2601/26; B65H 2403/60; B65H 2403/61
See application file for complete search history.

(56) References Cited

U.S. PATENT DOCUMENTS

2012/0193869 A1* 8/2012 Hanamoto ..... B65H 3/0684 271/225
2015/0217952 A1* 8/2015 Hamada ..... B65H 3/0684 271/227
2016/0236883 A1* 8/2016 Okada ..... B65H 3/0684

FOREIGN PATENT DOCUMENTS

JP H06-144624 A 5/1994
JP H10-120224 A 5/1998
(Continued)

OTHER PUBLICATIONS

International Search Report issued in PCT/JP2015/051664; dated Mar. 31, 2015.

*Primary Examiner* — Howard Sanders
(74) *Attorney, Agent, or Firm* — Studebaker & Brackett PC

(57) ABSTRACT

A sheet conveyance device (1) includes a feed tray (20), a feeding unit (50), a stopper (30), a first abutted portion (41), and an impact reducing mechanism (10). Sheets are loaded on the feed tray (20). The feeding unit (50) feeds the sheets. The stopper (30) is rotatably supported on the feeding unit (50) and rotates when pressed by the sheets inserted into the feed tray (20). The stopper (30) comes into contact with the first abutted portion (41) in association with the rotation of the stopper (30). The impact reducing mechanism (10) reduces impact applied to the first abutted portion (41) by the stopper (30).

14 Claims, 12 Drawing Sheets

(51) Int. Cl.

| | |
|---|---|
| ***B65H 3/06*** | (2006.01) |
| ***B65H 5/06*** | (2006.01) |
| ***G03G 15/00*** | (2006.01) |

(52) U.S. Cl.

CPC ..... *B65H 5/06* (2013.01); *B65H 5/062* (2013.01); *G03G 15/602* (2013.01); *G03G 15/6529* (2013.01); *B65H 2301/4222* (2013.01); *B65H 2403/60* (2013.01); *B65H 2404/6111* (2013.01); *B65H 2405/3321* (2013.01); *B65H 2601/26* (2013.01); *B65H 2801/06* (2013.01); *B65H 2801/39* (2013.01)

(56) References Cited

FOREIGN PATENT DOCUMENTS

| | | | |
|---|---|---|---|
| JP | 2005-008379 | A | 1/2005 |
| JP | 2007-230782 | A | 9/2007 |

* cited by examiner

SHEET CONVEYANCE DEVICE AND IMAGE FORMING APPARATUS

TECHNICAL FIELD

The present invention relates to a sheet conveyance device and an image forming apparatus.

BACKGROUND ART

Patent Literature 1 describes a document conveyance device. A typical document conveyance device having a structure similar to this document conveyance device will be described with reference to FIG. 12. The document conveyance device 500 includes a stopper 501, a rib 505 serving as a guide, and a feeding unit 504 pivotally supporting the stopper 501. An end face of the rib 505 functions as an abutted portion 503. The stopper 501 rotates when pressed by original document sheets (that is, an example of a sheet) inserted into a feed tray, so as to bring an abutting portion 502 of the stopper 501 into contact with the abutted portion 503. Then, the feeding unit 504 lowers to a position where it is in contact with the original document sheets, and thus, starts to feed the original document sheets.

CITATION LIST

Patent Literature

Patent Literature 1

Japanese Patent Application Laid-Open Publication No. 2007-230782

SUMMARY OF INVENTION

Technical Problem

There is, however, a possibility of the abutted portion 503 damaged or chipped by impact applied to the abutted portion 503 from the abutting portion 502 because of forced insertion of the original document sheets into the feed tray. Therefore, there is a possibility that the abutted portion 503 has a cut or a defect, and an edge of the abutting portion 502 may be caught by the cut or the like of the abutted portion 503 in some cases. As a result, there is a possibility that the feeding unit 504 is inhibited from lowering, which may lead to occurrence of a feeding failure of the original document sheets. In particular, the abutted portion 503 is easily damaged because it is the end face of the rib 505 in a thin plate shape.

The present invention was accomplished in consideration of the above-described problem, and an object is to provide a sheet conveyance device and an image forming apparatus capable of suppressing the occurrence of a sheet feeding failure.

Solution to Problem

According to a first aspect of the present invention, a sheet conveyance device includes a feed tray, a feeding unit, a stopper, a first abutted portion, and an impact reducing mechanism. Sheets are loaded on the feed tray. The feeding unit feeds the sheets. The stopper is rotatably supported on the feeding unit to rotate when pressed by the sheets inserted into the feed tray. The stopper comes into contact with the first abutted portion in association with rotation of the stopper. The impact reducing mechanism reduces impact applied to the first abutted portion by the stopper.

According to a second aspect of the present invention, an image forming apparatus includes the sheet conveyance device according to the first aspect of the present invention, and an image forming section. The image forming section forms an image borne on a sheet having been conveyed by the sheet conveyance device, or forms an image on a sheet having been conveyed by the sheet conveyance device.

Advantageous Effects of Invention

According to the present invention, the impact reducing mechanism reduces impact applied by the stopper to the first abutted portion. Therefore, damage of the first abutted portion is suppressed, and the inhibition of lowering of the feeding unit can be suppressed. As a result, the feeding unit smoothly lowers, and hence occurrence of a sheet feeding failure is suppressed.

DESCRIPTION OF EMBODIMENTS

Figure 1:
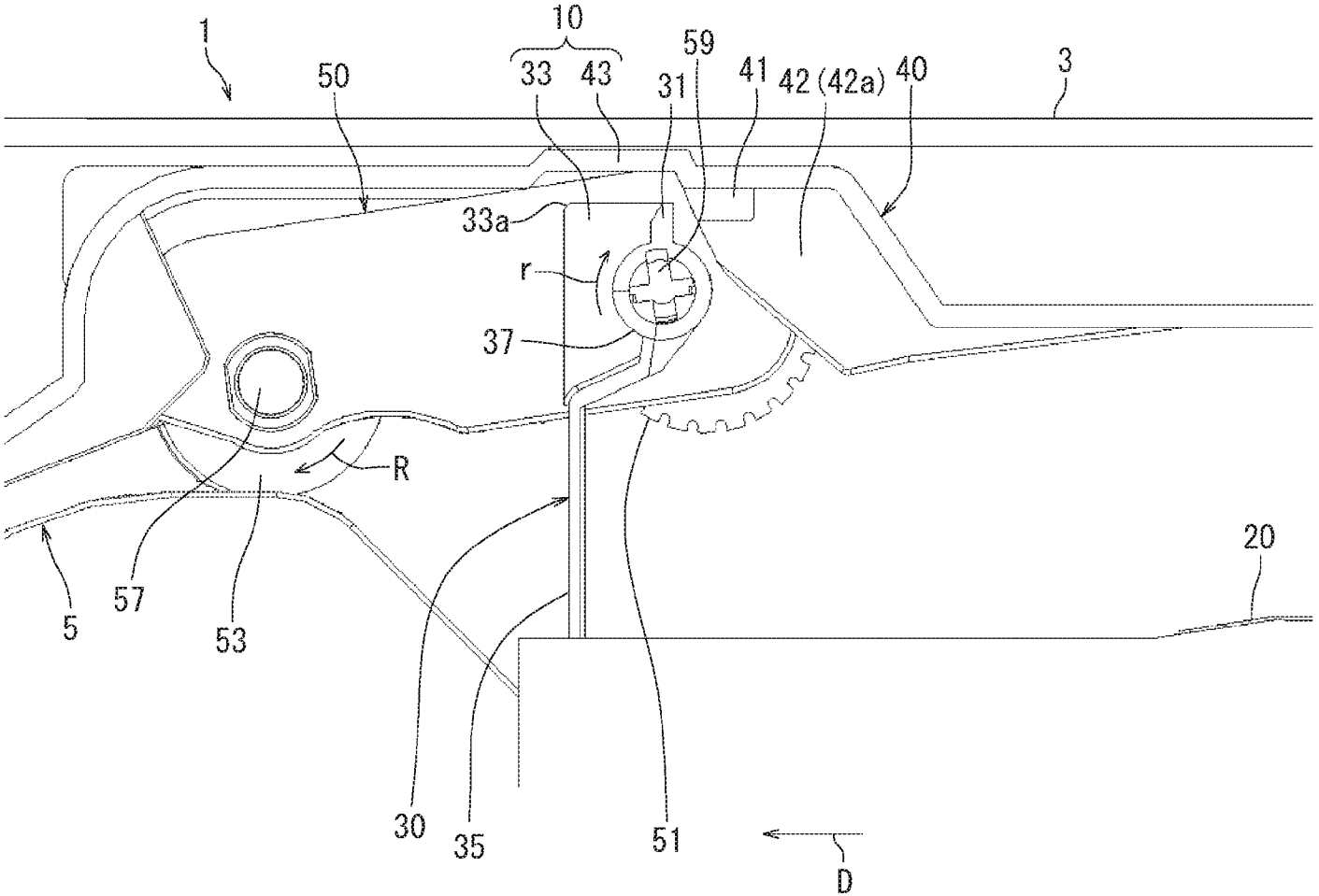
FIG. 1 is a schematic cross-sectional view of a stopper and a surrounding portion of a sheet conveyance device according to a first embodiment of the present invention.

Embodiments of the present invention will now be described with reference to the accompanying drawings. It is noted that like reference numerals are used to refer to like or corresponding elements in the drawings so as to avoid redundant description.

First Embodiment

The basic principle of an original document conveyance device 1 according to a first embodiment of the present invention will be described with reference to FIG. 1. FIG. 1 illustrates the original document conveyance device 1. The original document conveyance device 1 includes a feed tray 20, a feeding unit 50, a stopper 30, a first abutted portion 41, and an impact reducing mechanism 10. The original document conveyance device 1 functions as a sheet conveyance device.

On the feed tray 20, original document sheets are loaded. The feeding unit 50 feeds the original document sheets. The stopper 30 is rotatably supported on the feeding unit 50 so as to rotate when pressed by the original document sheets inserted into the feed tray 20. In association with the rotation of the stopper 30, the stopper 30 comes into contact with the first abutted portion 41. The impact reducing mechanism 10 reduces impact applied by the stopper 30 to the first abutted portion 41. The original document sheet is an example of a sheet. The sheet is, for example, plain paper, recycled paper, thin paper, cardboard, or an OHP (Overhead Projector) sheet.

According to the first embodiment, the impact reducing mechanism 10 reduces the impact applied to the first abutted portion 41 by the stopper 30. Accordingly, damage of the first abutted portion 41 is suppressed, and inhibition of lowering of the feeding unit 50 can be suppressed. As a result, the feeding unit 50 smoothly lowers, and occurrence of a feeding failure of the original document sheets is suppressed.

[Details of Original Document Conveyance Device 1]

Referring to FIGS. 1 to 3, the original document conveyance device 1 will be described in detail. As illustrated in FIG. 1, the impact reducing mechanism 10 includes a second abutting portion 33 and a second abutted portion 43. The second abutting portion 33 is formed in the stopper 30. The second abutted portion 43 is formed in a guide member 40. The stopper 30 includes a first abutting portion 31, a stopper piece 35, and an attaching portion 37. The stopper 30 is rotatably supported on the feeding unit 50 via the attaching portion 37 in a cylindrical shape. The first abutting portion 31 is a projection protruding upward from the circumferential surface of the attaching portion 37. The stopper piece 35 is in a plate shape, is disposed to sandwich, together with the first abutting portion 31, the attaching portion 37, and extends downward from the circumferential surface of the attaching portion 37. The second abutting portion 33 is in a plate shape, and is formed to extend from the first abutting portion 31 to the base of the stopper piece 35. The second abutting portion 33 has a substantially right-angled corner 33*a*.

Figure 2A:
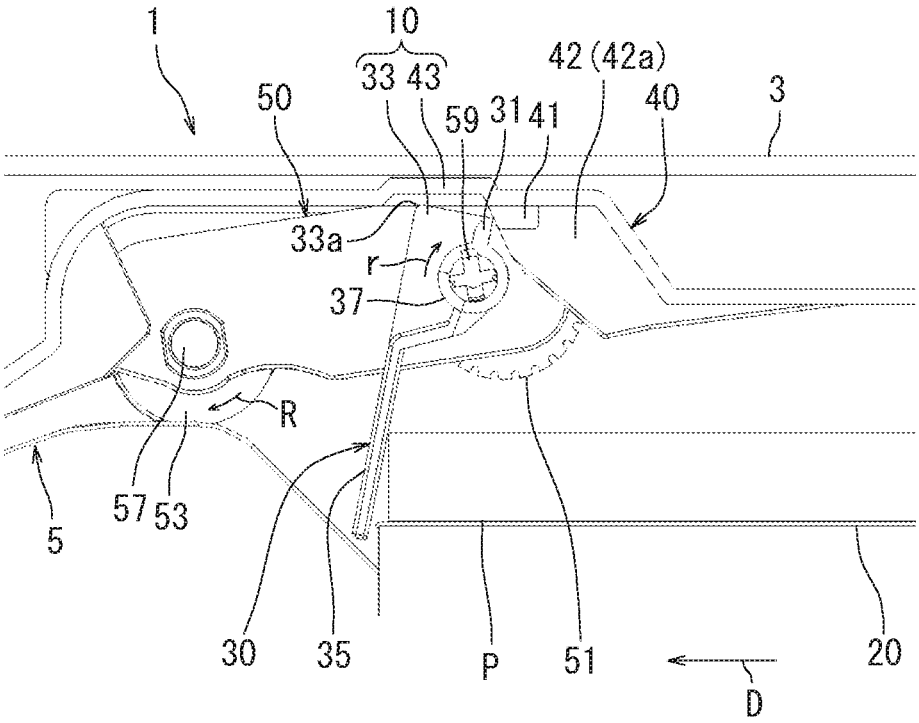
FIG. 2A is a view of a state where a feeding unit of the sheet conveyance device according to the first embodiment of the present invention has retreated to a retreat position and original document sheets are set on a feed tray.

The original document sheets P are, for example, normally inserted or forcedly inserted into the original document conveyance device 1. The operation of the original document conveyance device 1 performed when the original document sheets P are normally inserted will now be described. FIG. 2A is a view of a state where the feeding unit 50 has retreated to a retreat position and the original document sheets P are set on the feed tray 20. In FIG. 2A, the original document sheets P are normally inserted. The retreat position refers to a position of the feeding unit 50 having retreated above the feed tray 20. The stopper piece 35 receives the original document sheets P inserted into the feed tray 20. In other words, when the original document sheets P are inserted in an original document feeding direction (hereinafter referred to as the "feeding direction D") and the stopper piece 35 is pressed by the original document sheets P, the stopper 30 rotates clockwise (in a direction of an arrow r). Then, in association with the rotation of the stopper 30, the first abutting portion 31 comes into contact with the first abutted portion 41. Therefore, the rotation of the stopper 30 is stopped, and the leading edges of the original document sheets P are aligned to be perpendicular to the feeding direction D by the stopper piece 35. As a result, the original document sheets P are inhibited from being fed to a conveyance path 5 in a skewed manner.

Figure 2B:
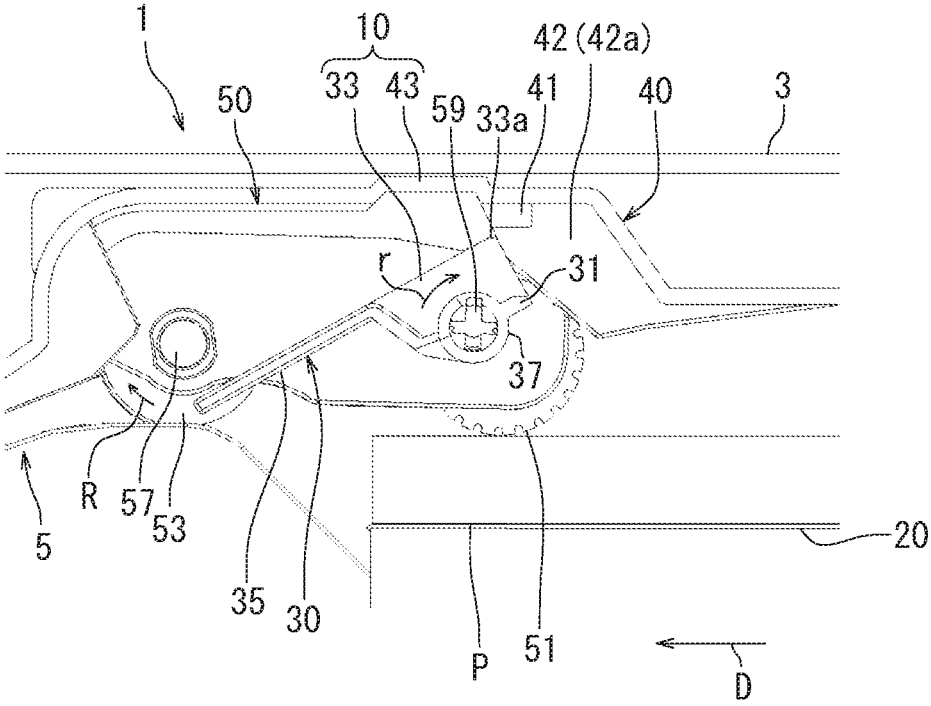
FIG. 2B is a view of a state where the feeding unit of the sheet conveyance device according to the first embodiment of the present invention has lowered to a feed position.

FIG. 2B illustrates a state where the feeding unit 50 has lowered to a feed position. When the feeding operation for the original document sheets P is started, the feeding unit 50 lowers from the retreat position to the feed position where it is in contact with the original document sheets P. The feed position refers to a position where the feeding unit 50 is in contact with the original document sheets P. Then, a pickup roller 51 rotates to feed each of the original document sheets P in the feeding direction D.

Figure 3A:
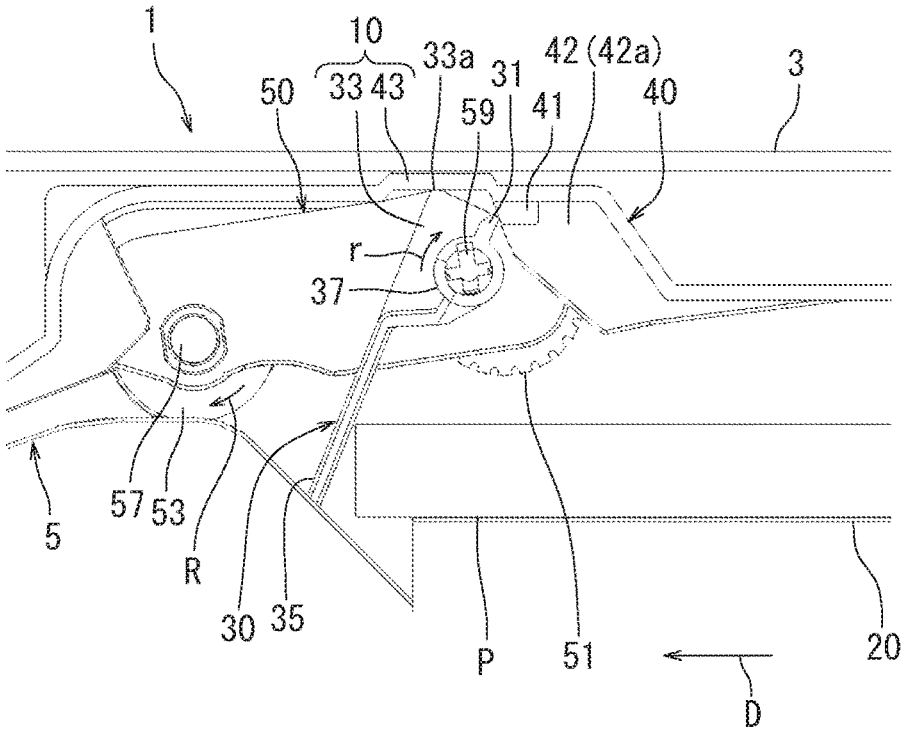
FIG. 3A is a view of a state where the original document sheets are forcedly inserted into the feed tray of the sheet conveyance device according to the first embodiment of the present invention.

Next, an operation of the original document conveyance device 1 performed when the original document sheets P are forcedly inserted will be described. FIG. 3A illustrates a state where the original document sheets P have been forcedly inserted. When the original document sheets P are forcedly inserted into the feed tray 20, the second abutting portion 33 comes into contact with the second abutted portion 43.

Specifically, when the stopper 30 is pressed by the original document sheets P with a force beyond a prescribed pressing force, the stopper 30 is deformed and hence the second abutting portion 33 comes into contact with the second abutted portion 43. In other words, when the original document sheets P are forcedly inserted, the first abutting portion 31 comes into contact with the first abutted portion 41, and in addition, the stopper 30 is further pressed by the original document sheets P. Since the stopper 30 is made from an elastic material, the shape of the stopper 30 is deformed, and hence the corner 33*a* of the second abutting portion 33 comes into contact with the second abutted portion 43.

Accordingly, the impact (or load) from the stopper 30 to the first abutted portion 41 based on the forced insertion is not only applied to the first abutted portion. 41 but also dispersed between the first abutted portion 41 and the second abutted portion 43. As a result, the impact (or load) from the stopper 30 to the first abutted portion 41 is reduced. Incidentally, the prescribed pressing force can be set to an arbitrary value on the basis of, for example, the features of the stopper 30 such as the material of the stopper 30, the shape of the second abutting portion 33, and the size of the stopper piece 35, the positional relationship between the corner 33*a* and the second abutted portion 43, and/or the positional relationship between the first abutting portion 31 and the first abutted portion 41.

Figure 3B:
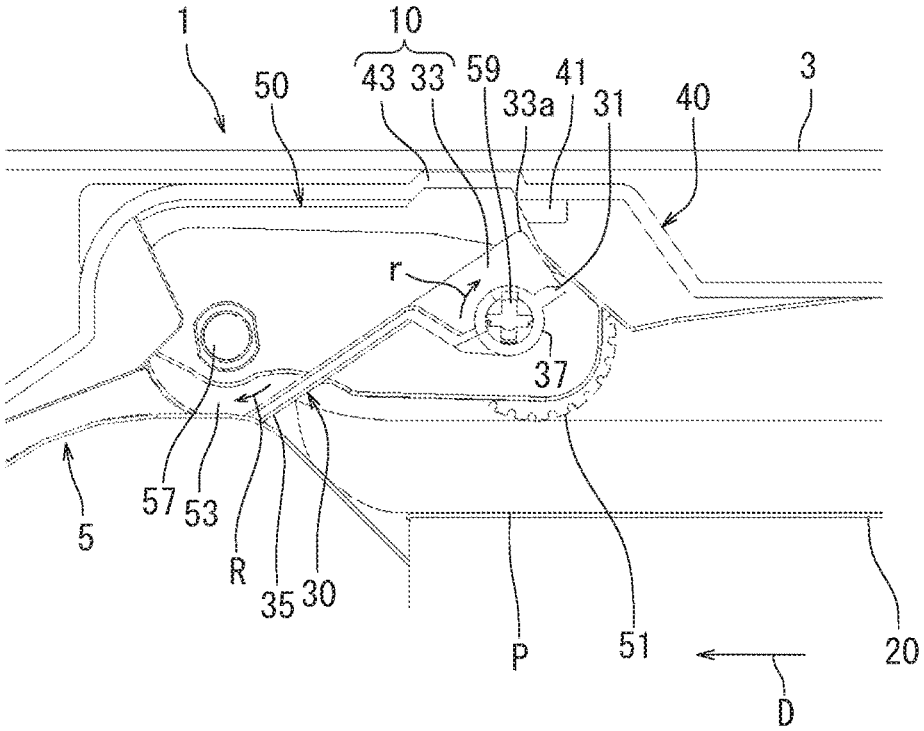
FIG. 3B is a view of a state where the feeding unit has lowered when the original document sheets are forcedly inserted into the feed tray of the sheet conveyance device according to the first embodiment of the present invention.

FIG. 3B illustrates a state where the feeding unit 50 has lowered when the original document sheets P are forcedly inserted. After the impact reducing mechanism 10 reduces the impact from the first abutting portion 31 to the first abutted portion 41, the feeding unit 50 lowers from the retreat position to the feed position where it is in contact with the original document sheets P. In other words, the feeding unit 50 lowers because of the impact. Then, the pickup roller 51 starts to rotate with the original document sheets P forcedly inserted. Accordingly, the original document sheets P are multi-fed and jammed in the conveyance path 5, and hence, the feeding operation for the original document sheets P is stopped. As a result, a user is caused to recognize that the feeding operation of the original paper conveyance device 1 is stopped when the original document sheets P are forcedly inserted, and thus, the user can be warned against the forced insertion of the original document sheets P.

Besides, the lowering of the feeding unit 50 releases the contact between the first abutting portion 31 and the first abutted portion 41. Accordingly, the stopper 30 loses its function as the stopper 30. As a result, the load from the stopper 30 is not continuously applied to the first abutted portion 41. In other words, damage of the first abutted portion 41 otherwise caused by the impact from the first abutting portion 31 to the first abutted portion 41 is suppressed.

Figure 4A:
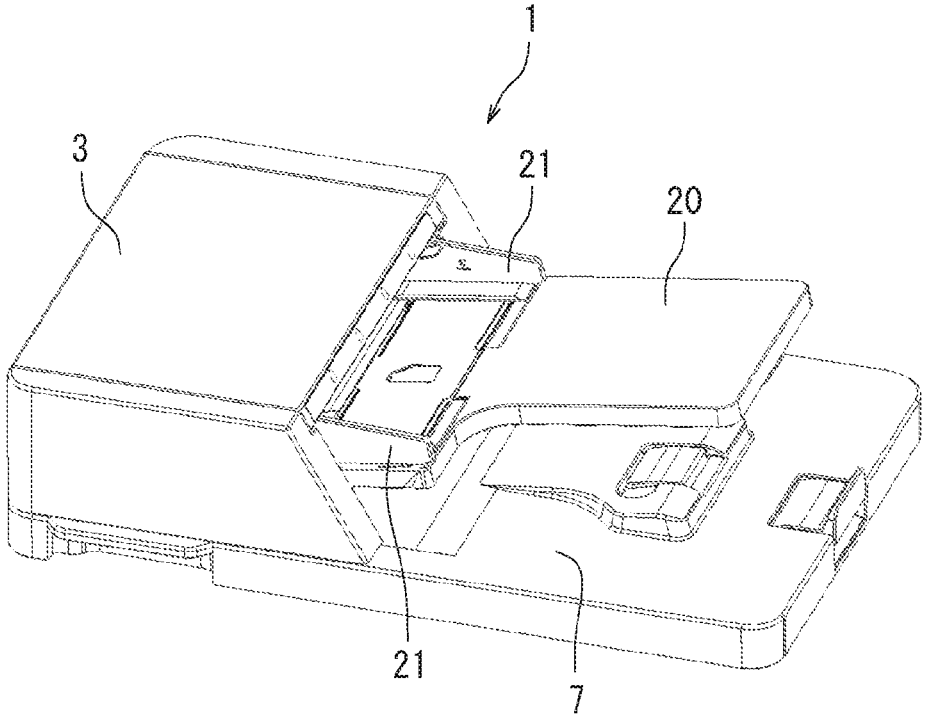
FIG. 4A is a perspective view of a state where a cover of the sheet conveyance device according to the first embodiment of the present invention is closed.
Figure 4B:
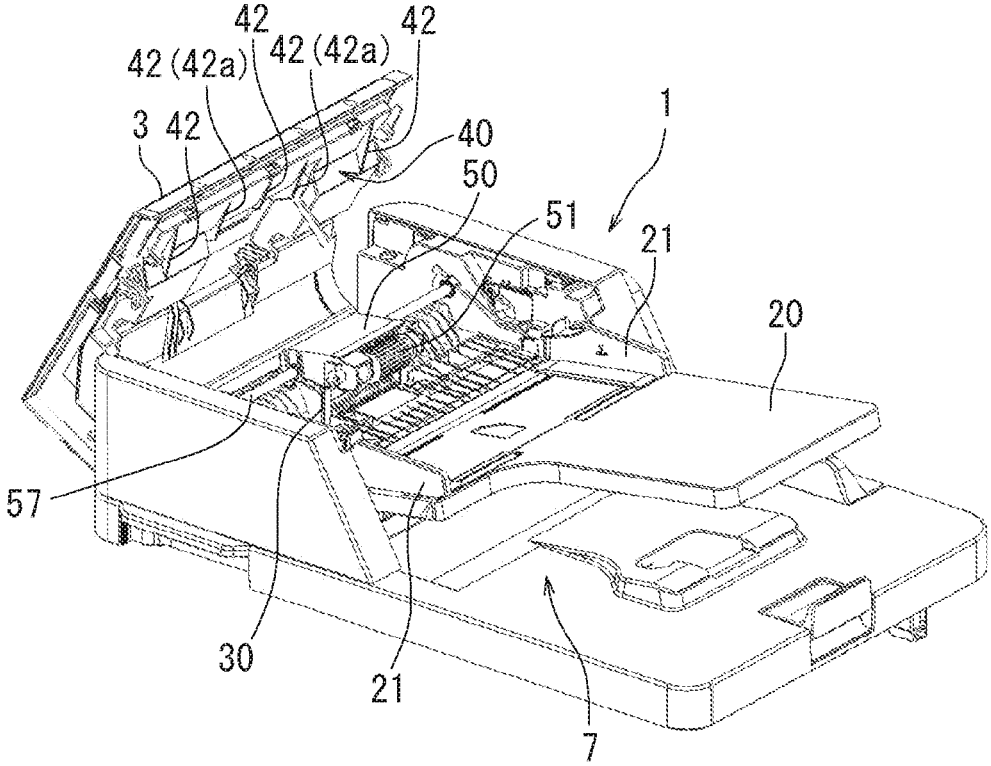
FIG. 4B is a perspective view of a state where the cover of the sheet conveyance device according to the first embodiment of the present invention is opened.

Next, referring to FIG. 4, the whole structure of the original document conveyance device 1 will be described. FIG. 4A illustrates the original document conveyance device 1 with a cover 3 closed. The original document conveyance device 1 is disposed on an upper surface of an image reading section of an image forming apparatus. FIG. 4B illustrates the original document conveyance device 1 with the cover 3 opened. The original document conveyance device 1 further includes the cover 3 and an exit tray 7. The cover 3 corresponds to an upper portion of the original document conveyance device 1, and is openable and closable. The cover 3 covers a base end portion of the feed tray 20 and the feeding unit 50 when closed. The feeding unit 50 is disposed downstream of the base end portion of the feed tray 20 in terms of the feeding direction D.

The exit tray 7 is disposed below the feed tray 20. An original document sheet P having been conveyed inside the original document conveyance device 1 is ejected onto the exit tray 7. A pair of cursors 21 is disposed on the feed tray 20. The pair of cursors 21 holds the original document sheets P loaded on the feed tray 20 therebetween, so as to inhibit the original document sheets P from being inserted in a skewed manner.

As illustrated in FIGS. 1 and 4B, the guide member 40 is disposed on a rear surface of the cover 3. The first abutted portion 41 and the second abutted portion 43 are formed on the guide member 40. Specifically, a plurality of plate-shaped ribs 42 are formed on the guide member 40 in terms of the feeding direction D. The plural ribs 42 guide the original document sheets P toward the pickup roller 51. The first abutted portion 41 is formed in a downstream end portion of a rib 42*a* out of the plural ribs 42 in terms of the feeding direction D. An abutted surface of the first abutted portion 41 is inclined upward toward the downstream in terms of the feeding direction. D. The first abutting portion 31 comes into contact with this abutted surface. The second abutted portion 43 is formed downstream, in terms of the feeding direction D, of the first abutted portion 41 in the guide member 40. The second abutted portion 43 has a flat surface extending in terms of the feeding direction D, and the corner 33*a* comes into contact with this flat surface.

Figure 5:
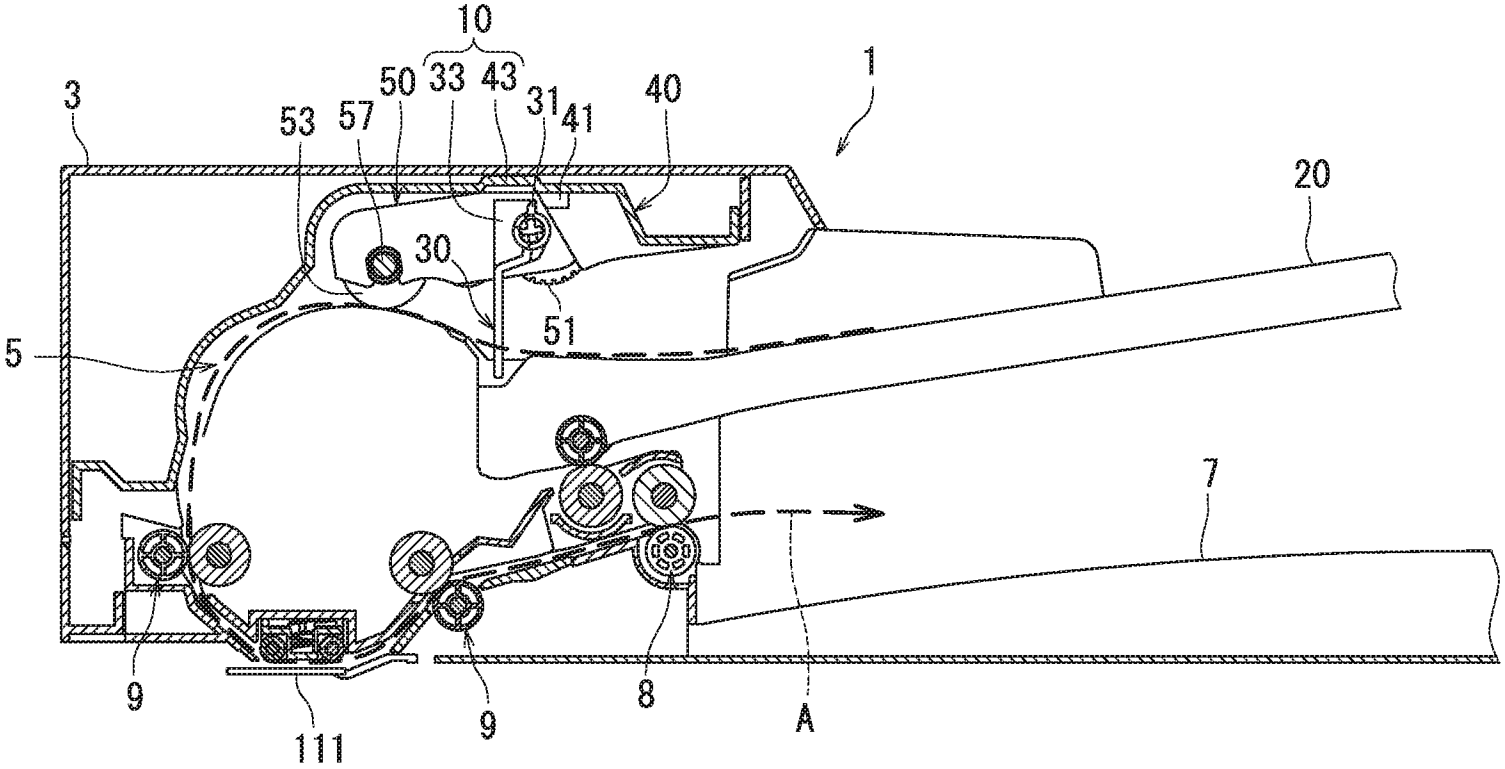
FIG. 5 is a schematic cross-sectional view of the sheet conveyance device according to the first embodiment of the present invention.

Next, referring to FIG. 5, the internal structure of the original document conveyance device 1 will be described. FIG. 5 is a cross-sectional view of the original document conveyance device 1. The original document conveyance device 1 further includes an exit roller pair 8 and a plurality of conveyance roller pairs 9. Each original document sheet P is conveyed along a conveyance path A. Specifically, the original document sheet P is fed to the conveyance path 5 by the pickup roller 51 and a feeding roller 53, conveyed through the conveyance path 5 by the conveyance roller pairs 9, and ejected onto the exit tray 7 by the exit roller pair 8. The original document sheet P passes contact glass 111 disposed on the conveyance path 5. Then, an image borne on the original document sheet P is read via the contact glass 111 by the image reading section.

Figure 6A:
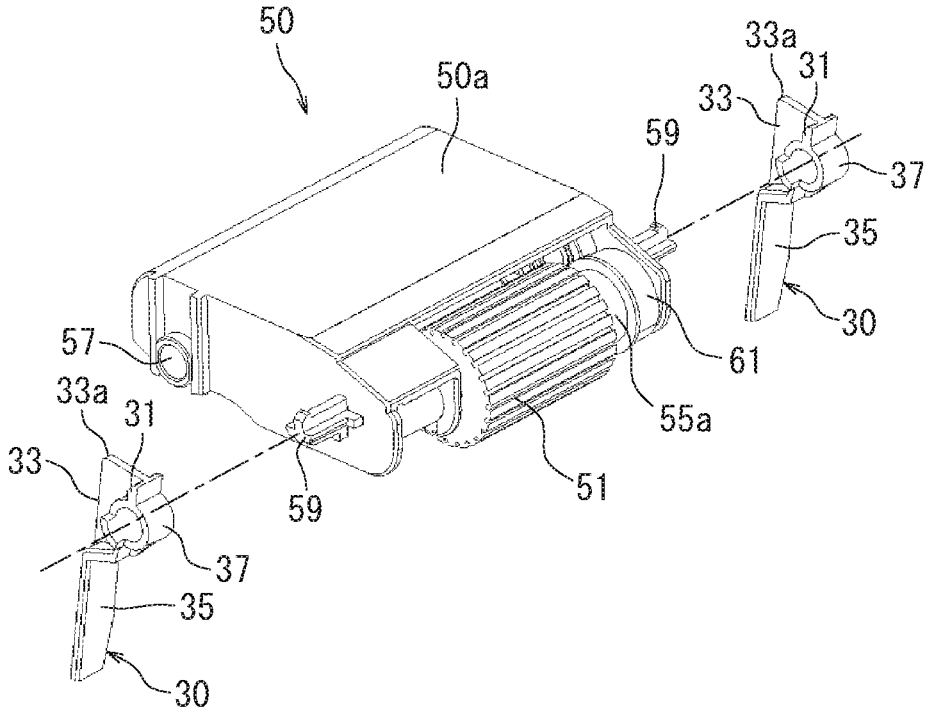
FIG. 6A is a perspective view taken from above of the feeding unit of the sheet conveyance device according to the first embodiment of the present invention.

Next, referring to FIGS. 6 and 7, the feeding unit 50 will be described in detail. FIG. 6A is a perspective view taken from above of the feeding unit 50. The feeding unit 50 includes a frame 50*a*. A pair of joint spiders 59 protrudes respectively from side surfaces of the frame 50*a*. The pair of joint spiders 59 corresponds to a pair of stoppers 30. Each stopper 30 is rotatably supported on the corresponding joint spider 59. The stopper 30 can rotate by its own weight. Specifically, the joint spider 59 is inserted into a cylindrical hole formed in the attaching portion 37.

Figure 6B:
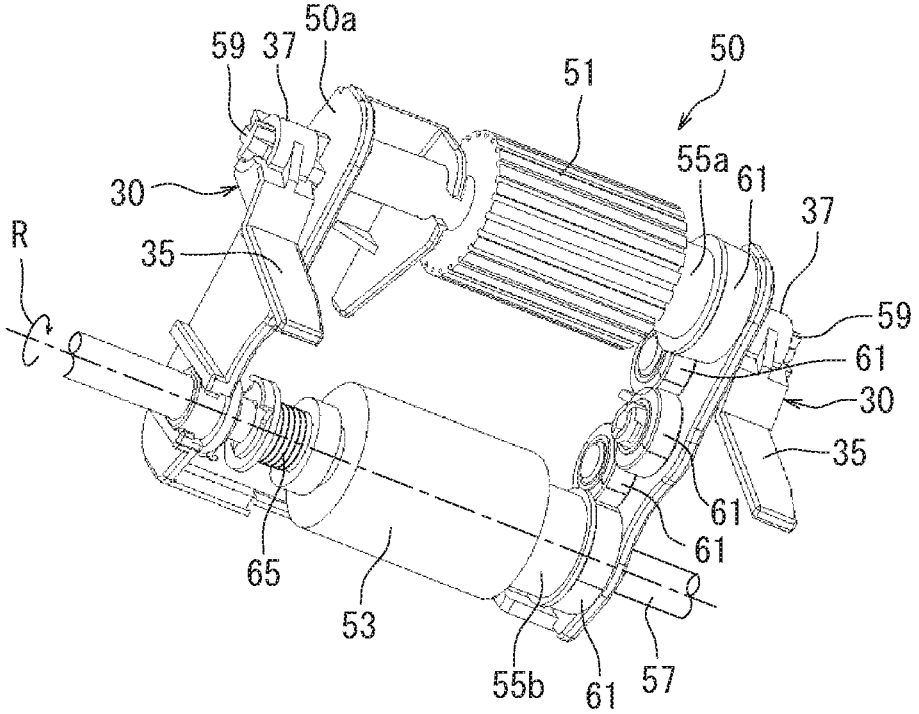
FIG. 6B is a perspective view taken from below of the feeding unit of the sheet conveyance device according to the first embodiment of the present invention.
Figure 7:
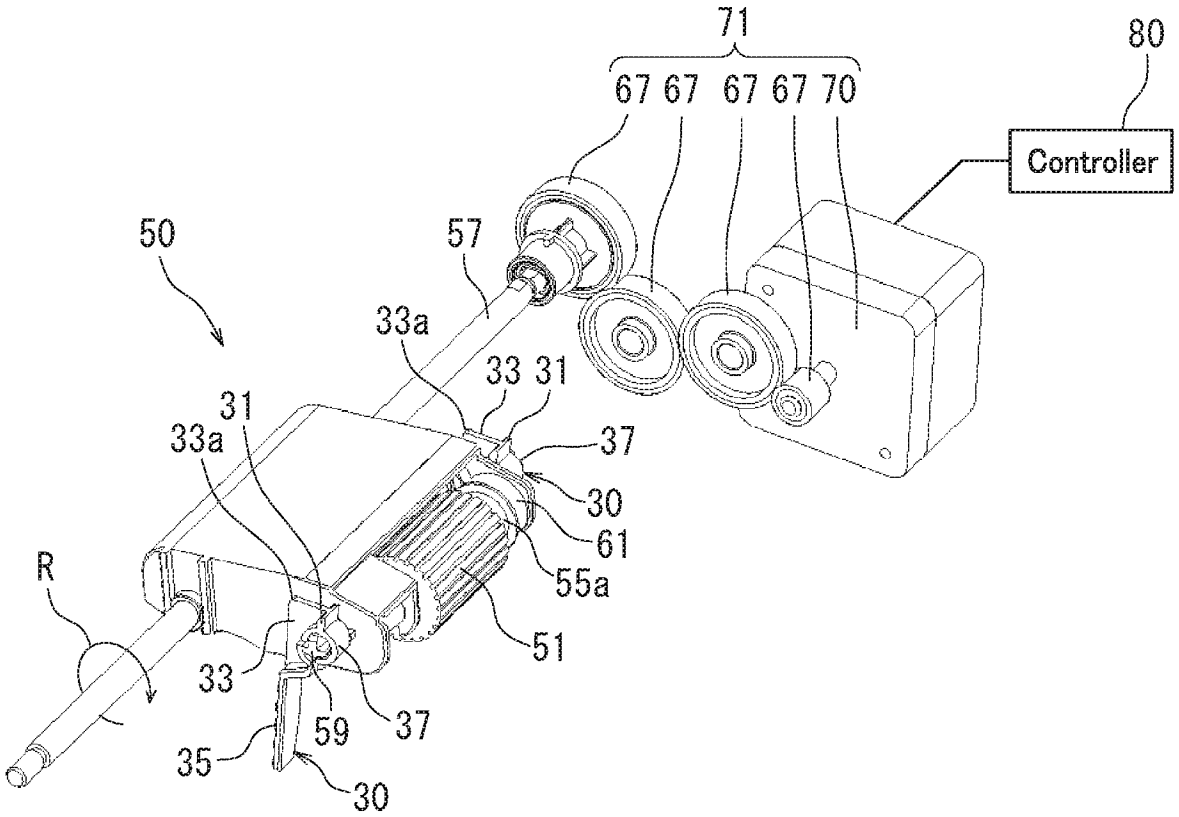
FIG. 7 is a view of the feeding unit connected to a driving source of the sheet conveyance device according to the first embodiment of the present invention.

FIG. 6B is a perspective view taken from below of the feeding unit 50. FIG. 7 illustrates the feeding unit 50 connected to a driving source 71. The feeding unit 50 further includes the pickup roller 51, the feeding roller 53, a one-way clutch 55*a*, a one-way clutch 55*b*, a plurality of gears 61, and a helical torsion spring 65 used as a coil spring. The driving source 71 includes a plurality of gears 67 and a motor 70.

The pickup roller 51 and the feeding roller 53 are rotatably supported on the frame 50*a*. The pickup roller 51 and the feeding roller 53 are connected to each other via a plurality of gears 61. The feeding roller 53 is connected to the motor 70 via the plurality of gears 67 and a shaft 57.

A controller 80 drives the motor 70 to rotate the shaft 57 in a rotational direction R. The rotational direction R corresponds to the feeding direction D. When the shaft 57 rotates in the rotational direction R, the one-way clutch 55*a* transmits the driving force of the motor 70 to the feeding roller 53, and the one-way clutch 55*b* transmits the driving force of the motor 70 to the pickup roller 51. Accordingly, the pickup roller 51 and the feeding roller 53 rotate correspondingly to the feeding direction D, so as to feed each original document sheet P in the feeding direction D.

On the other hand, the controller 80 drives the motor 70 to rotate the shaft 57 in a direction opposite to the rotational direction R. When the shaft 57 rotates in the direction opposite to the rotational direction R, neither the one-way clutch 55*a* transmits the driving force of the motor 70 to the feeding roller 53 nor the one-way clutch 55*b* transmits the driving force of the motor 70 to the pickup roller 51.

The helical torsion spring 65 is inserted on the shaft 57. The helical torsion spring 65 presses the frame 50*a* in the direction opposite to the rotational direction R for placing the pickup roller 51 in the retreat position. When the shaft 57 is rotated in the rotational direction R by the motor 70, the frame 50*a* rotates around the shaft 57 in the rotational direction R against the pressing force of the helical torsion spring 65. As a result, a tip portion of the frame 50*a* is lowered, so as to move the pickup roller 51 from the retreat position to the feed position. On the other hand, when the shaft 57 is rotated in the direction opposite to the rotational direction R by the motor 70, the frame 50*a* rotates around the shaft 57 in the opposite direction. As a result, the tip portion of the frame 50*a* is elevated, so as to move the pickup roller 51 from the feed position to the retreat position.

The pressing force of the helical torsion spring 65 is larger than a force (namely, a lowering force caused by the weight) with which the tip portion of the frame 50*a* is lowered by the weight of the tip portion of the frame 50*a* (including the pickup roller 51 and the gears 61). Accordingly, even when the driving force in the direction opposite to the rotational direction R is released, the pickup roller 51 remains in the retreat position. On the other hand, the pressing force of the helical torsion spring 65 is smaller than an added force of the lowering force caused by the weight and an impact force applied when the second abutting portion 33 comes into contact with the second abutted portion 43. Accordingly, the tip portion of the frame 50*a* is lowered by the impact caused when the second abutting portion 33 comes into contact with the second abutted portion 43, and hence the pickup roller 51 moves from the retreat position to the feed position.

Figure 8A:
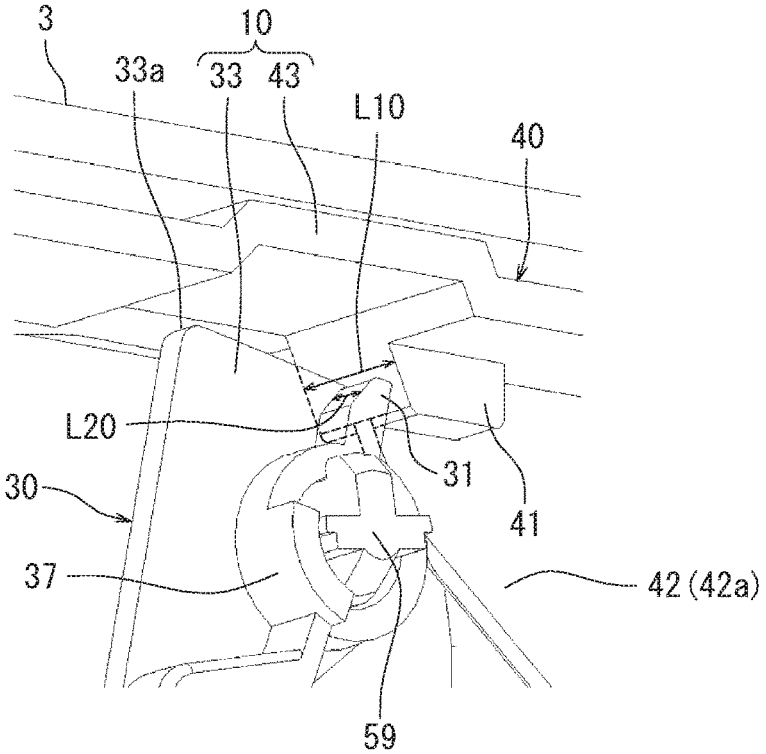
FIG. 8A is an enlarged view of a state where a first abutting portion and a first abutted portion of a stopper of the sheet conveyance device according to the first embodiment of the present invention are in contact with each other.
Figure 8B:
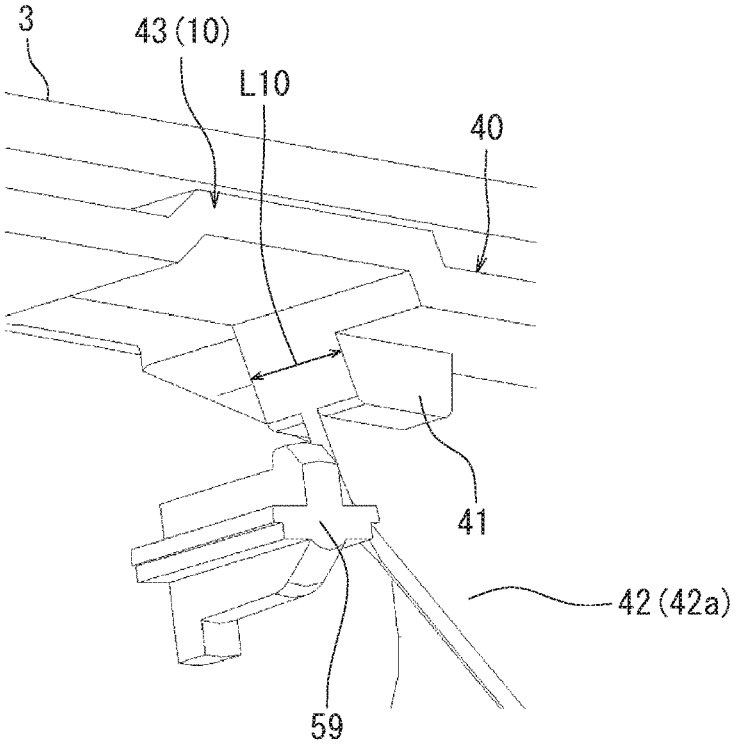
FIG. 8B is an enlarged view of the first abutted portion of the stopper of the sheet conveyance device according to the first embodiment of the present invention.

Next, referring to FIG. 8, the shape of the first abutted portion 41 will be described. FIG. 8A is an enlarged view of a state where the first abutting portion 31 is in contact with the first abutted portion 41, and FIG. 8B is an enlarged view of the first abutted portion 41. In FIG. 8B, the stopper 30 is not illustrated.

A first width L10 of the first abutted portion 41 is larger than a second width L20 of the first abutting portion 31. Each of the first width L10 and the second width L20 refers to a width along the joint spider 59 (a rotation axis) of the stopper 30.

Figure 12:
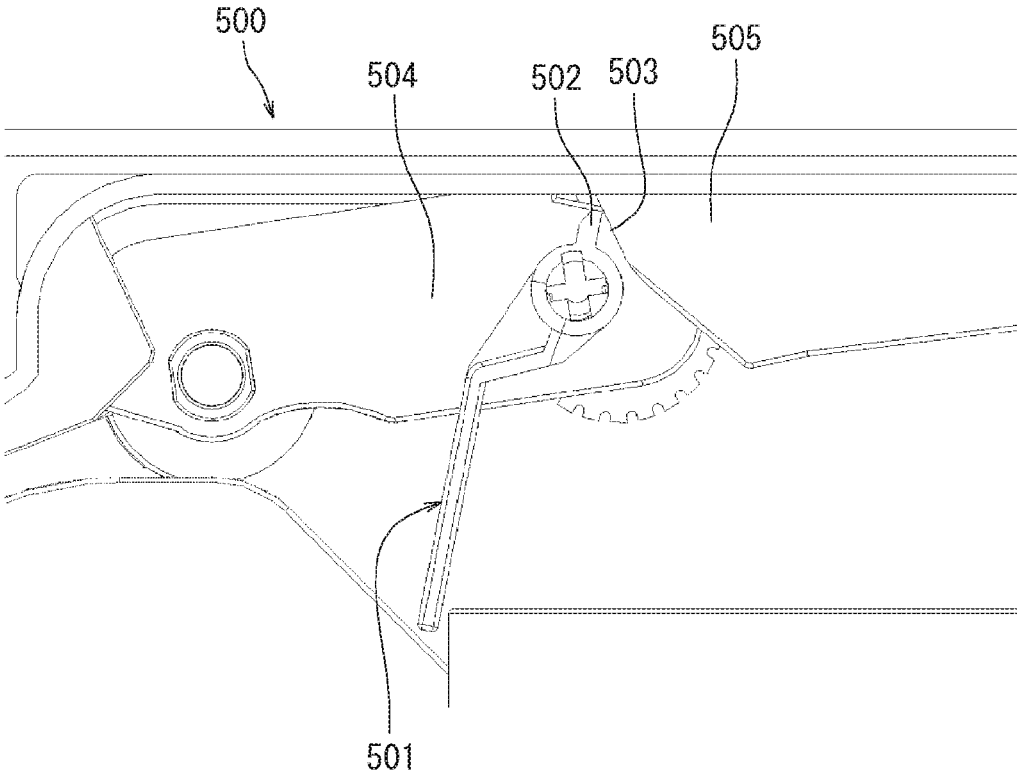
FIG. 12 is a schematic cross-sectional view of a typical sheet conveyance device.

Since the first width L10 is larger than the second width L20, a contact area between the first abutting portion 31 and the first abutted portion 41 is larger than a contact area between the typical abutting portion 502 and the typical abutted portion 503 (see FIG. 12). Accordingly, the impact per unit area applied from the first abutting portion 31 to the first abutted portion 41 is smaller. As a result, the damage of the first abutted portion 41 is further suppressed, and the occurrence of a feeding failure of the original document sheets P is further suppressed. It is noted that the first width L10 may be the same as the second width L20. Alternatively, the first width L10 may be smaller than the second width L20.

As described so far with reference to FIGS. 1 to 8, according to the first embodiment, the impact applied from the first abutting portion 31 to the first abutted portion 41 caused by the forced insertion of the original document sheets P is reduced by the second abutting portion 33 and the second abutted portion 43 serving as the impact reducing mechanism 10. Accordingly, the damage of the first abutted portion 41 otherwise caused by the impact is suppressed, and hence, the inhibition of the lowering of the feeding unit 50 otherwise caused when caught by the first abutted portion 41 in feeding an original document sheet P can be suppressed. As a result, the feeding unit 50 smoothly lowers, and the occurrence of a feeding failure of the original document sheets P is suppressed.

Second Embodiment

Figure 9:
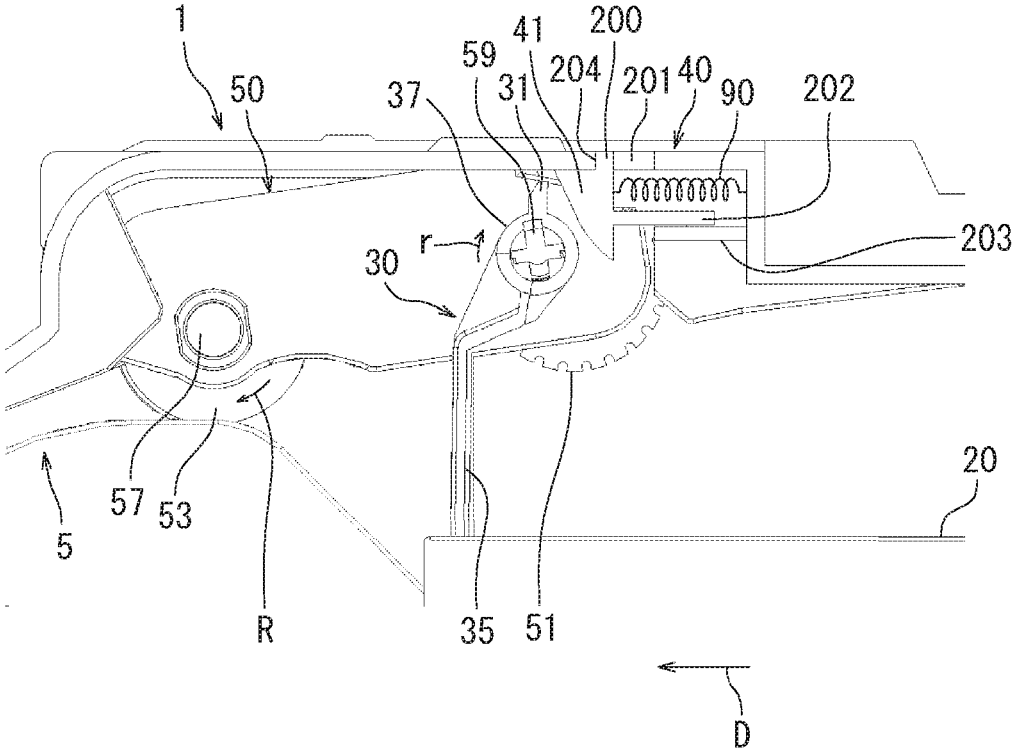
FIG. 9 is a schematic cross-sectional view of a stopper and a surrounding portion of a sheet conveyance device according to a second embodiment of the present invention.

Referring to FIGS. 9 and 10, an original document conveyance device 1 according to a second embodiment of the present invention will be described. The structure of the original document conveyance device 1 of the second embodiment is similar to that of the original document conveyance device 1 of the first embodiment. However, the impact reducing mechanism 10 of the original document conveyance device 1 of the second embodiment includes a pressing member 90 instead of the second abutting portion 33 and the second abutted portion 43. Now, a difference between the second embodiment and the first embodiment will be principally described. The original document conveyance device 1 functions as a sheet conveyance device.

FIG. 9 illustrates the stopper 30 and a surrounding portion of the original document conveyance device 1. In FIG. 9, the stopper 30 is in a basic position not in contact with the original document sheets. The structure of the stopper 30 is the same as that of the stopper 30 of the first embodiment 1 except that the second abutting portion 33 is not formed. Specifically, the stopper 30 includes the first abutting portion 31, the attaching portion 37, and the stopper piece 35. The first abutted portion 41 is disposed in the guide member 40. The pressing member 90 presses the first abutted portion 41 toward the first abutting portion 31 (in terms of the feeding direction D). The pressing member 90 is, for example, a spring.

Specifically, the impact reducing mechanism 10 further includes a projecting portion 200, a guide groove 201, a base member 202, a supporting portion 203, and a stopper 204. The projecting portion 200 is formed in an upper portion of the first abutted portion 41. By contrast, the guide groove 201 extending in terms of the feeding direction D is formed in the guide member 40. The projecting portion 200 is inserted into the guide groove 201. Besides, the abutted surface of the first abutted portion 41 is inclined upwardly downstream in terms of the feeding direction D. The first abutting portion 31 comes into contact with the abutted surface. The base member 202 is formed in the first abutted portion 41. The base member 202 extends in terms of the feeding direction D from a surface opposite to the abutted surface. The base member 202 is supported by the supporting portion 203 formed in the guide member 40.

The first abutted portion 41 is slidable along the guide groove 41 and the supporting portion 203. In other words, the first abutted portion 41 is slidable in terms of the feeding direction D. When the stopper 30 is in the basic position, and when the original document sheets are normally inserted, the projecting portion 200 of the first abutted portion 41 is in contact with the stopper 204 formed in the guide member 40 owing to the pressing three of the pressing member 90. The stopper 204 is disposed at a downstream end of the guide groove 201 in terms of the feeding direction D.

The pressing force of the pressing member 90 is set to be a magnitude sufficient for preventing the first abutted portion 41 from moving in the direction opposite to the feeding direction D when the original document sheets P are normally inserted, that is, when the original document sheets P press the stopper 30 with a pressing force equal to or smaller than the prescribed pressing force. In other words, the pressing force of the pressing member 90 is set to a magnitude sufficient for moving the first abutted portion 41 in the direction opposite to the feeding direction D when the original document sheets P are forcedly inserted, that is, the stopper 30 is pressed by the original document sheets P with a force exceeding the prescribed pressing force.

The first width L10 of the first abutted portion 41 is larger than the second width L20 of the first abutting portion 31 (see FIG. 8A). Each of the first width L10 and the second width L20 refers to a width along the joint spider 59 (the rotation axis) of the stopper 30. In the same manner as in the first embodiment, the impact per unit area applied from the first abutting portion 31 to the first abutted portion 41 is reduced, and hence, the damage of the first abutted portion 41, and accordingly the occurrence of a feeding failure is suppressed. Incidentally, the first width L10 may be the same as the second width L20. Alternatively, the first width L10 may be smaller than the second width L20.

An operation of the feeding unit 50 and the stopper 30 performed when the original document sheets are normally inserted is the same as that of the first embodiment and hence the description is omitted. An operation of the feeding unit 50 and the stopper 30 performed when the original document sheets are forcedly inserted will now be described.

Figure 10A:
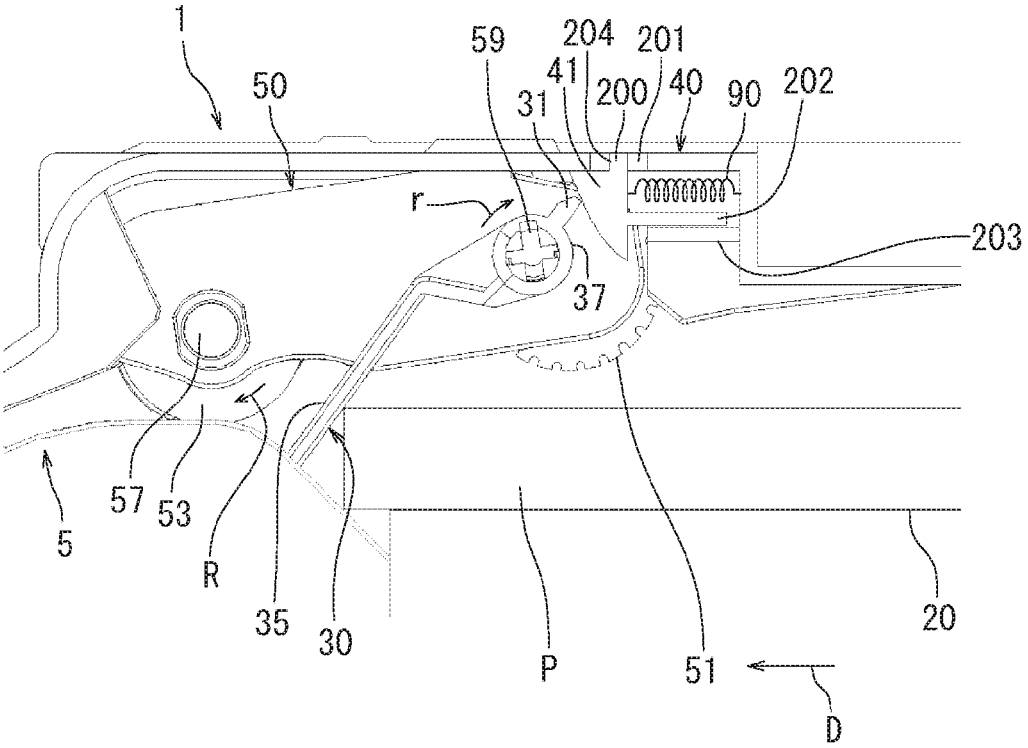
FIG. 10A is a view of a state where original document sheets are forcedly inserted into a feed tray of the sheet conveyance device according to the second embodiment of the present invention.

FIG. 10A illustrates a state where the original document sheets P are forcedly inserted. When the original document sheets P are forcedly inserted into the feed tray 20, that is, when the stopper 30 is pressed by the original document sheets P with a force exceeding the prescribed pressing force, the first abutting portion 31 comes into contact with the first abutted portion 41, and further presses the first abutted portion 41 in the direction opposite to the feeding direction D against the pressing force of the pressing member 90. As a result, the first abutted portion 41 moves in the direction opposite to the feeding direction D, and the impact from the first abutting portion 31 is thus absorbed. In other words, the pressing member 90 serving as the impact reducing mechanism 10 reduces the impact.

Figure 10B:
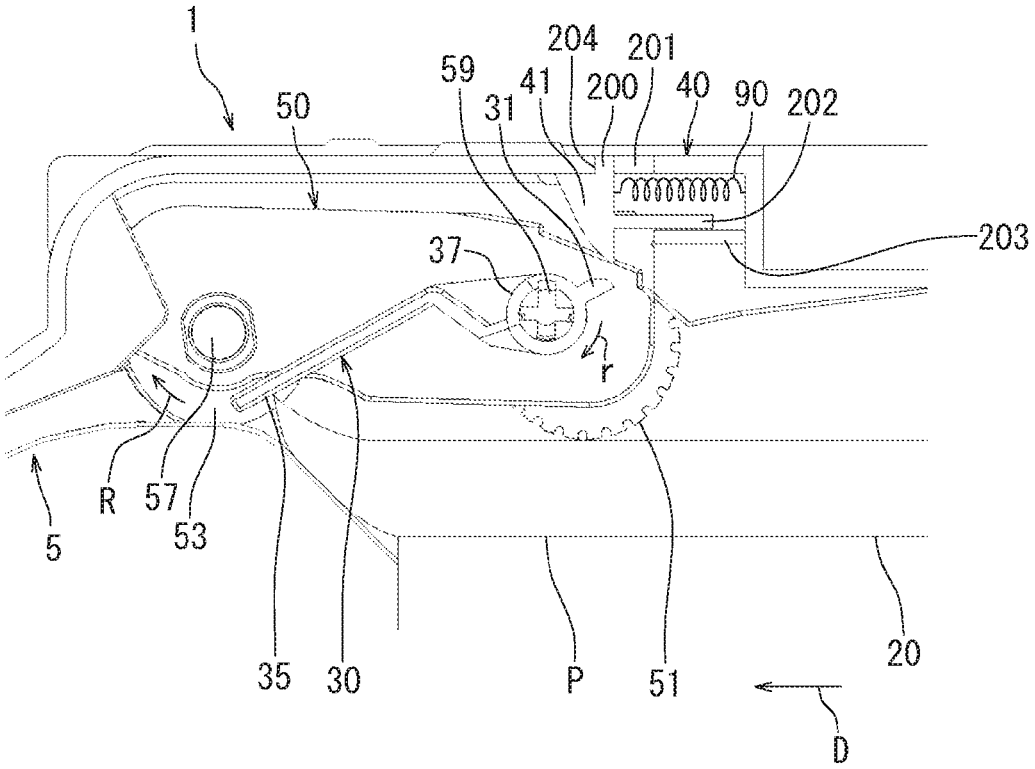
FIG. 10B is a view of a state where a feeding unit has lowered when original document sheets are forcedly inserted into the feed tray of the sheet conveyance device according to the second embodiment of the present invention.

FIG. 10B illustrates a state where the feeding unit 50 has lowered when the original document sheets P are forcedly inserted. After the impact reducing mechanism 10 reduces the impact from the first abutting portion 31 to the first abutted portion 41, the feeding unit 50 lowers from the retreat position to the feed position where it is in contact with the original document sheets P. In other words, since the first abutted portion 41 moves in the direction opposite to the feeding direction D, the contact between the first abutting portion 31 and the first abutted portion 41 is released, and the feeding unit 50 lowers owing to the impact from the first abutting portion 31 to the first abutted portion 41 and the weight of the tip portion (including the pickup roller 51 and the gears 61) of the feeding unit 50.

Then, the pickup roller 51 starts to rotate with the original document sheets P forcedly inserted. Accordingly, the original document sheets P are multi-fed and jammed in the conveyance path 5, and hence, the feeding operation for the original document sheets P is stopped. As a result, the user can be warned against the forced insertion of the original document sheets P in the same manner as in the first embodiment.

Besides, the lowering of the feeding unit 50 releases the contact between first abutting portion 31 and the first abutted portion 41. Accordingly, the stopper 30 loses its function as the stopper 30. As a result, in the same manner as in the first embodiment, the damage of the first abutted portion 41 otherwise caused by continuous load application from the stopper 30 to the first abutted portion 41 is suppressed.

As described so far with reference to FIGS. 9 and 10, according to the second embodiment, the impact applied from the first abutting portion 31 to the first abutted portion 41 caused by the forced insertion of the original document sheets P is reduced by the pressing member 90 serving as the impact reducing mechanism 10. Accordingly, the damage of the first abutted portion 41 otherwise caused by the impact is suppressed, and hence, the inhibition of the lowering of the feeding unit 50 otherwise caused when caught by the first abutted portion 41 in feeding an original document sheet P can be suppressed. As a result, the feeding unit 50 smoothly lowers, and the occurrence of a feeding failure of the original document sheets P is suppressed.

Third Embodiment

Figure 11:
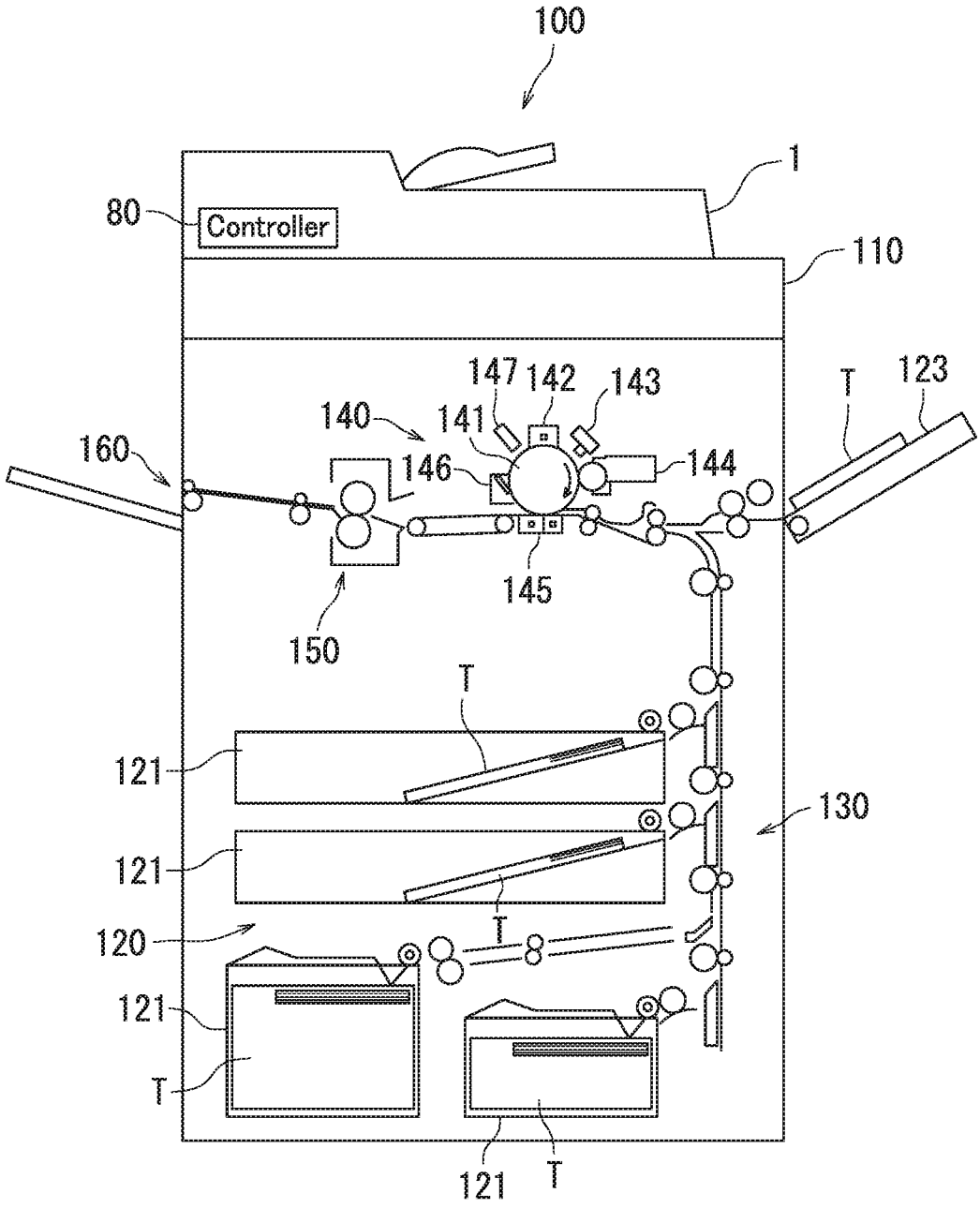
FIG. 11 is a schematic cross-sectional view used for describing the outline structure of an image forming apparatus according to a third embodiment of the present invention.

Referring to FIG. 11, an image forming apparatus 100 according to a third embodiment of the present invention will be described. FIG. 11 is a schematic cross-sectional view used for describing the outline structure of the image forming apparatus 100. The image forming apparatus 100 is, for example, a copier, a printer, a facsimile machine, or a multifunction peripheral. A multifunction peripheral includes, for example, at least two devices out of a copier, a printer, and a facsimile machine.

The image forming apparatus 100 includes an original document conveyance device 1, a controller 80, an image reading section 110, a feeding section 120, a conveyance section 130, an image forming section 140, a fixing section 150, and an exit section 160. The controller 80 controls the respective elements of the image forming apparatus 100. Besides, the controller 80 functions as the controller 80 of the first embodiment or the second embodiment.

The original document conveyance device 1 corresponds to the original document conveyance device 1 of the first embodiment or the second embodiment. The original document conveyance device 1 conveys each original document sheet P toward the image reading section 110. The image reading section 110 reads an image borne on the original document sheet P for generating image data. The feeding section 120 feeds sheets T loaded on a cassette 121 or a manual feed tray 123 (a sheet conveyance device) to the conveyance section 130. Incidentally, each structure of the original document conveyance devices 1 of the first embodiment and the second embodiment can be applied to a mechanism for feeding the sheets T from the manual feed tray 123. In other words, the impact reducing mechanism 10 according to the present invention is applicable to a case where the sheets T are inserted into the manual feed tray 123.

The conveyance section 130 conveys each sheet T to the image forming section 140. The image forming section 140 forms an image on the sheet T on the basis of image data. The image data corresponds to, for example, the image data generated by the image reading section 110. In the above configuration, the image forming section 140 forms, on the sheet T, an image borne on each original document sheet P having been conveyed by the original document conveyance device 1. Specifically, the image forming section 140 forms an image on each sheet T by using a photosensitive drum 141, a charging section 142, an exposing section 143, a developing section 144, and a transferring section 145. Besides, the image forming section 140 includes a cleaning section 146 and a discharging section 147.

The sheet T bearing the image formed thereon is conveyed toward the fixing section 150. The fixing section 150 heats and presses the sheet T for fixing the image on the sheet T. The sheet T bearing the image fixed thereon is conveyed toward the exit section 160. The exit section 160 ejects the sheet T.

As described so far with reference to FIG. 11, according to the third embodiment, since the original document conveyance device 1 of the first embodiment or the second embodiment is used, the occurrence of a feeding failure of the sheets T can be suppressed in the same manner as in the first embodiment or the second embodiment. In addition, the same advantages as those of the first embodiment or the second embodiment can be attained.

The embodiments of the present invention have been described so far with reference to the accompanying drawings (FIGS. 1 to 12). The present invention is, however, not limited to these embodiments, but can be practiced in various aspects without departing from the scope of the invention. In the respective drawings, the respective constituent elements are principally schematically illustrated so as to be easily understood, and the thicknesses, the lengths, the numbers and the like of the respective constituent elements illustrated in these drawings may be different from the actual dimensions, and the like for convenience of drawing. Besides, the shapes, the dimensions, and the like of the respective constituent elements described in the above-described embodiments are merely exemplary and not restrictive, and can be variously changed or modified without substantially departing from the spirit of the present invention.

INDUSTRIAL APPLICABILITY

The present invention is applicable to the field of sheet conveyance devices and image forming apparatuses.

The invention claimed is:

1. A sheet conveyance device comprising:
a feed tray on which a sheet is to be loaded;
a feeding unit configured to feed the sheet;
a cover covering the feed tray and the feeding unit;
a guide member disposed on a rear surface of the cover;
a stopper rotatably supported on the feeding unit and configured to rotate when pressed by the sheet inserted into the feed tray;
a first abutted portion which is formed on the guide member and with which the stopper comes into contact in association with rotation of the stopper; and
an impact reducing mechanism configured to reduce impact to the first abutted portion from the stopper, wherein
the stopper includes a first abutting portion that comes into contact with the first abutted portion in association with the rotation of the stopper,
the impact reducing mechanism includes:
a second abutted portion formed on the guide member; and
a second abutting portion that is disposed in the stopper and that comes into contact with the second abutted portion through deformation of the stopper when the stopper is pressed by the sheet with a force beyond a prescribed pressing force,
the feeding unit includes a feeding roller in contact with a conveyance path of the sheet, and
the second abutting portion is spaced apart from the second abutted portion before the rotation of the stopper.

2. The sheet conveyance device according to claim 1,
wherein the first abutted portion has a first width equal to or larger than a second width of the first abutting portion, and
each of the first width and the second width refers to a width along a rotation axis of the stopper.

3. The sheet conveyance device according to claim 1, wherein
after the impact reducing mechanism reduces the impact, the feeding unit lowers from a retreat position to a feed position where the feeding unit is in contact with the sheet.

4. The sheet conveyance device according to claim 3, wherein
the feeding unit includes a coil spring, and
the coil spring presses the feeding unit in a manner to place the feeding unit in the retreat position.

5. The sheet conveyance device according to claim 1, wherein
the stopper is made from an elastic material.

6. The sheet conveyance device according to claim 1, wherein
the stopper includes a stopper piece configured to receive the sheet inserted into the feed tray, and
the stopper piece is in a plate shape.

7. An image forming apparatus, comprising:
the sheet conveyance device according to claim 1; and
an image forming section configured to form an image borne on the sheet having been conveyed by the sheet conveyance device or form an image on the sheet having been conveyed by the sheet conveyance device.

8. A sheet conveyance device comprising:
a feed tray on which a sheet is to be loaded;
a feeding unit configured to feed the sheet;
a stopper rotatably supported on the feeding unit and configured to rotate when pressed by the sheet inserted into the feed tray;
a first abutted portion with which the stopper comes into contact in association with rotation of the stopper; and
an impact reducing mechanism configured to reduce impact to the first abutted portion from the stopper, wherein
the stopper includes a first abutting portion that comes into contact with the first abutted portion in association with the rotation of the stopper,
the impact reducing mechanism includes:
a spring configured to press the first abutted portion toward the first abutting portion;
a guide groove extending along a feeding direction of the sheet;
a base member formed in the first abutted portion and extending along the feeding direction of the sheet; and
a supporting portion supporting the base member,
the feeding unit includes a feeding roller in contact with a conveyance path of the sheet,
when the stopper is pressed by the sheet with a force beyond a prescribed pressing force, the first abutting portion comes into contact with the first abutted portion and presses the first abutted portion in a direction opposite to the feeding direction of the sheet against a pressing force of the spring, and
the first abutted portion is slidable along the guide groove and the supporting portion.

9. The sheet conveyance device according to claim 8, wherein after the impact reducing mechanism reduces the impact, the feeding unit lowers from a retreat position to a feed position where the feeding unit is in contact with the sheet.

10. The sheet conveyance device according to claim 9, wherein the feeding unit includes a coil spring, and the coil spring presses the feeding unit in a manner to place the feeding unit in the retreat position.

11. The sheet conveyance device according to claim 8, wherein the stopper is made from an elastic material.

12. The sheet conveyance device according to claim 8, wherein the stopper includes a stopper piece configured to receive the sheet inserted into the feed tray, and the stopper piece is in a plate shape.

13. The sheet conveyance device according to claim 8, wherein the pressing force of the pressing member is set to a magnitude sufficient for moving the first abutted portion in the direction opposite to the feeding direction of the sheet when the stopper is pressed by the sheet with the force beyond the prescribed pressing force.

14. An image forming apparatus, comprising:

the sheet conveyance device according to claim 8; and an image forming section configured to form an image borne on the sheet having been conveyed by the sheet conveyance device or form an image on the sheet having been conveyed by the sheet conveyance device.

* * * * *